US007714688B2

(12) United States Patent
Korony et al.

(10) Patent No.: US 7,714,688 B2
(45) Date of Patent: May 11, 2010

(54) HIGH Q PLANAR INDUCTORS AND IPD APPLICATIONS

(75) Inventors: Gheorghe Korony, Myrtle Beach, SC (US); Robert H. Heistand, II, Myrtle Beach, SC (US)

(73) Assignee: AVX Corporation, Myrtle Beach, SC (US)

( * ) Notice: Subject to any disclaimer, the term of this patent is extended or adjusted under 35 U.S.C. 154(b) by 1015 days.

(21) Appl. No.: 11/334,051

(22) Filed: Jan. 18, 2006

(65) Prior Publication Data

US 2006/0158300 A1 Jul. 20, 2006

Related U.S. Application Data

(60) Provisional application No. 60/645,507, filed on Jan. 20, 2005.

(51) Int. Cl.
*H01F 5/00* (2006.01)

(52) U.S. Cl. ..... 336/200

(58) Field of Classification Search ..... 336/65, 336/83, 107, 192, 200, 232
See application file for complete search history.

(56) References Cited

U.S. PATENT DOCUMENTS

| | | | | |
|---|---|---|---|---|
| 4,757,285 | A * | 7/1988 | Krause | 333/203 |
| 5,451,914 | A | 9/1995 | Stengel | |
| 5,760,456 | A | 6/1998 | Grzegorek et al. | |
| 6,175,727 | B1 * | 1/2001 | Mostov | 455/307 |
| 6,420,773 | B1 | 7/2002 | Liou | |
| 6,559,751 | B2 | 5/2003 | Liu et al. | |
| 6,593,841 | B1 | 7/2003 | Mizoguchi et al. | |
| 6,639,298 | B2 | 10/2003 | Chaudhry et al. | |
| 6,664,882 | B2 | 12/2003 | Andoh et al. | |
| 6,714,112 | B2 | 3/2004 | Beng et al. | |
| 6,759,937 | B2 | 7/2004 | Kyriazidou | |
| 6,798,039 | B1 | 9/2004 | Gillespie et al. | |
| 6,809,623 | B2 | 10/2004 | Kyriazidou et al. | |
| 6,825,749 | B1 | 11/2004 | Lin et al. | |
| 6,894,585 | B2 * | 5/2005 | Keeney et al. | 333/132 |
| 7,126,443 | B2 * | 10/2006 | De Bhailis et al. | 333/185 |
| 7,253,712 | B1 * | 8/2007 | Papananos | 336/200 |
| 7,370,403 | B1 * | 5/2008 | Hsu et al. | 29/602.1 |
| 7,382,222 | B1 * | 6/2008 | Manetakis | 336/200 |
| 7,474,190 | B2 * | 1/2009 | Strzalkowski et al. | 336/200 |
| 2004/0111881 | A1 * | 6/2004 | Yang et al. | 29/835 |

OTHER PUBLICATIONS

Niknejad, Ali M., Meyer, Robert G. and Tham, Joo Leong, "Fully-Integrated Low Phase Noise Bipolar Differential VCOs at 2.9 and 4.4 GHz".

(Continued)

*Primary Examiner*—Tuyen Nguyen
(74) *Attorney, Agent, or Firm*—Dorrity & Manning, P.A.

(57) ABSTRACT

Disclosed is methodology and apparatus for producing a planar inductor having a high quality (Q) factor. The inductor is formed by providing a first, relatively wide coil turn, and at least a pair of relatively more narrow second coil turns, displaced in a different plane from that occupied by the first coil turn. The configuration of such coil turns produces a high value of mutual coupling among the coil turns, resulting in an inductor having a high quality (Q) factor.

11 Claims, 2 Drawing Sheets

OTHER PUBLICATIONS

Pan, Shu-Jun, Yin, Wen-Yan and Li, Le-Wei, "Comparative Investigation on Various On-Chip Center-Tapped Interleaved Transformers", Dec. 27, 2003.

Pieters, Philip and Beyne, Eric, published abstract Spiral Inductors Integrated in MCM-D Using the Design Space Concept, 1998.

Chinoy, Percy B. and Tajadod, James, "Processing and Microwave Characterization of Multilevel Interconnects Using Benzocyclobutene Dielectric", IEEE Transactions on Components, Hybrids, and Manufacturing Technology, vol. 16, No. 7, Nov. 1993.

Chinoy, Percy B., "Processing and Electrical Characterization of Multilayer Metallization for Microwave Applications", ICEMCM 1995.

Pieters, Philip, Brebels, Steven, and Beyne, Eric, "Integrated Microwave Filters in MCM-D", IEEE Multi-Chip Module Conference, Santa Cruz, CA, Feb. 6-7, 1996.

Pieters, Philip, Brebels, Steven, and Beyne, Eric, "Integration of Passive Components for Microwave Filters in MCM-D", 6th International Conference and Exhibition on Multichip Modules, Denver, CO, Apr. 2-4, 1997.

* cited by examiner

HIGH Q PLANAR INDUCTORS AND IPD APPLICATIONS

PRIORITY CLAIM

This application claims priority to previously filed U.S. Provisional Application entitled "High Q Planar Inductors And IPD Applications" assigned Ser. No. 60/645,507, filed on Jan. 20, 2005 which is incorporated herein by reference for all purposes.

FIELD OF THE INVENTION

The presently disclosed technology relates to the provision of High Q Planar Inductors and their applications in Integrated Passive Devices (IPDs). The present technology has particular applicability to the design of either Thin-film or printed circuit wiring board Integrated Passive Devices, and to the design of small, integrated radio frequency (RF) devices.

BACKGROUND OF THE INVENTION

Many modern electronic components are packaged as monolithic devices, and may comprise a single component or multiple components within a single chip package. One specific example of such a monolithic device is a multilayer capacitor or capacitor array. Other monolithic electronic components correspond to devices that integrate multiple passive components into a single chip structure. Such an integrated passive component may provide a selected combination of resistors, capacitors, inductors and/or other passive components that are formed in a multilayered configuration and packaged as a monolithic electronic device.

The ongoing development of Integrated Passive Devices or Components (IPDs or IPCs) has recently become more significant in the design of reduced sized electronic devices. Recent developments in the area of IPDs have followed two main development branches. A first development branch has addressed the inclusion of multiple passive components integrated in a chip without having a uniquely defined function. Non-limiting examples of developments along this branch include quadruple capacitors arrays, multiple resistor networks, and multiple varistor arrays. A second development branch has addressed the inclusion of multiple passive components integrated into a chip in order to perform a well-defined function. Non-limiting examples of developments along this branch include resistive voltage dividers, R-2R circuits for D/A conversion, and more complicated devices including filters, matching networks, and complex power handling and feed-back circuits associated with application specific integrated circuits (ASICs).

One design challenge associated with the design of reduced sized inductive components, as may be employed as components associated with either of the two previously mentioned development paths, is the achievement of a high quality factor. As understood by one of ordinary skill in the art, quality factor in this context relates generally to the degree of loss experienced with use of an element or device. A high quality factor or high Q as relates to inductive components depends in part on a strong coupling between all the turns forming the inductor. Achieving such strong coupling, especially when the inductor may be or must be configured as a planar device, may become problematic when implementing Integrated Passive Devices.

Various component arrangements and corresponding methodologies are known from issued U.S. patents, including Stengel, U.S. Pat. No. 5,451,914; Grzegorek et al., U.S. Pat. No. 5,760,456; Liou. U.S. Pat. No. 6,420,773 B1; Liou U.S. Pat. No. 6,559,751 B2; Mizoguchi et al., U.S. Pat. No. 6,593,841 B1; Chaudhry et al., U.S. Pat. No. 6,639,298 B2; Andoh et al., U.S. Pat. No. 6,664,882 B2; Beng et al., U.S. Pat. No. 6,714,112 B2; Kyriazidou, U.S. Pat. No. 6,759,937 B2; Gillespie et al., U.S. Pat. No. 6,798,039 B1; Kyriazidou et al., U.S. Pat. No. 6,809,623 B2; and Lin et al., U.S. Pat. No. 6,825,749 B1; and from publications, including "Fully-Integrated Low Phase Noise Bipolar Differential VCOs at 2.9 and 4.4 GHz" by Ali M. Niknejad and Robert G. Meyer of University of California, Berkeley and Joo Leong Tham of Conexant Systems; "Comparative Investigation on Various On-Chip Center-Tapped Interleaved Transformers" by Shu-Jun Pan, Wen-Yan Yin, and Le-Wei Li, Dec. 27, 2003; Published Abstract entitled: "Spiral Inductors Integrated in MCM-D using the Design Space Concept" by Pieters et al., 1998; "Processing and Microwave Characterization of Multilevel Interconnects Using Benzocyclobutene Dielectric" by Chinoy et al., IEEE Transactions on Components, Hybrids, and Manufacturing Technology, Vol. 16, No. 7, November 1993; "Processing and Electrical Characterization of Multilayer Metallization for Microwave Applications" by Chinoy, ICEMCM 1995; "Integrated Microwave Filters in MCM-D" by Pieters et al., IEEE Multi-Chip Module Conference, Santa Cruz, Calif., Feb. 6-7, 1996; "Integration of Passive Components for Microwave Filters in MCM-D" by Pieters et al., 6th International Conference and Exhibition on Multichip Modules, Denver, Col., Apr. 2-4, 1997. The disclosures of all the forgoing United States patents are hereby fully incorporated into this specification for all purposes by reference thereto.

While various implementations of inductive devices have been developed for use in association with Integrated Passive Devices, no design has emerged that generally encompasses all of the desired characteristics as hereafter presented in accordance with the subject technology.

SUMMARY OF THE INVENTION

The present subject matter recognizes and addresses aspects of the foregoing issues, and others concerning various features of inductive components employable in association with Integrated Passive Devices (IPDs) and related technology. Thus, broadly speaking, an object of certain embodiments of the presently disclosed technology is to provide an improved component design for certain components that may be associated with the implementation of Integrated Passive Devices.

More particularly, it is an object of certain embodiments of the presently disclosed technology to provide reductions in size for certain components while at the same time providing improved operational characteristics for such components. Yet more particularly, it is an object of certain embodiments of the presently disclosed technology to provide reduced physical sized inductive devices. A still more particular object of the present technology relates to the provision of inductive devices having high quality (Q) factors as well as reduced size.

While Integrated Passive Devices (IPDs) have been previously supplied in surface mount technology (SMT) form, developments in accordance with the presently disclosed technology have been toward the production of thin-film, ball-grid array (BGA) terminated IPDs, as well as surface mount technology (SMT) IPDs. The present technology is equally applicable to printed circuit wiring board implementations. In accordance with such presently disclosed technology, Radio-Frequency (RF) IPDs have been developed providing functions including resonant circuits, filters, and matching networks. In light of such developments, it is a further object of certain embodiments of the present technology to provide thin film, high Q, planar inductors that may be used as an enabling technology for Lumped Element RF and Microwave Circuits.

In various exemplary present embodiments, the present subject matter may involve a planar inductor, comprising a substrate and first and second coils. In such present arrangement, such substrate preferably has upper and lower surfaces, and planar inductor further has a first coil having a first predetermined number of turns arranged in a first plane relative to one of the surfaces of such substrate, and a second coil having a second predetermined number of turns arranged in a second plane relative to one of the surfaces of such substrate, such second coil being vertically aligned with the first coil in a direction perpendicular to one of the surfaces of such substrate. In such a present exemplary embodiment, the first predetermined number of turns occupies a planar area which is substantially equal to a planar area occupied by said second predetermined number of turns.

In certain additional embodiments of the foregoing exemplary embodiment, the number of the second predetermined number of turns may be made to be twice the number of that of the first predetermined number of turns. Still further, in certain embodiments of such exemplary constructions, the first coil may advantageously be provided with at least one turn corresponding to a conductive element having a first predetermined width; and the second coil may have a plurality of turns, each of which such plurality of turns corresponds to individual planar conductors having individual widths corresponding to individual portions of the first predetermined width.

In certain of the foregoing exemplary embodiments, the substrate may comprise a printed circuit board.

In still further present exemplary embodiments, an integrated passive device may be provided in accordance with present subject matter, including a substrate having an upper surface and a lower surface, at least one passive device comprising one of capacitors and resistors supported by such substrate, and at least one planar inductor comprising a first coil having a first predetermined number of turns supported in a first plane relative to one of the surfaces of such substrate and a second coil having a second predetermined number of turns supported in a second plane relative to one of the surfaces of such substrate, the second coil being vertically aligned with said first coil in a direction perpendicular to one of the surfaces of such substrate. In such exemplary present embodiments, the first predetermined number of turns preferably occupies an area within the first plane which is substantially equal to an area occupied by the second predetermined number of turns within the second plane.

In such exemplary integrated passive devices in accordance with the present subject, terminations may be associated with beginning and end portions of both of the first and second coils, and at least one connection point associated with a mid portion of such second coil; wherein the first coil and second coil are electrically connected in series by way of such terminations, and wherein an inductor center-tap is provided by way of such connection point.

Still further, in such exemplary integrated passive devices in accordance with the present subject matter, such an exemplary device may comprise at least one conductive element supported by such substrate configured to couple the at least one passive device to the at least one planar inductor to selectively form an electrical circuit comprising one of resonant circuits, filters, and matching networks.

Still further present exemplary embodiments may encompass an elliptical band-pass filter, comprising a substrate having an upper surface and a lower surface, a plurality of capacitors supported by such substrate, and a plurality of inductors supported by said substrate. In such an arrangement, preferably at least one of the plurality of inductors is a planar inductor comprising a first coil having a first predetermined number of turns supported in a first plane relative to one of the surfaces of the substrate, and a second coil having a second predetermined number of turns supported in a second plane relative to one of the surfaces of such substrate, such second coil being vertically aligned with the first coil in a direction perpendicular to one of the surfaces of such substrate, and the first predetermined number of turns occupying an area within such first plane which is substantially equal to an the area occupied by such second predetermined number of turns within the second plane.

Still further, it is to be understood that the present technology equally applies to both the resulting devices and structures disclosed and/or discussed herewith, as well as the corresponding involved methodologies.

For example, present methodology includes a methodology for producing a planar inductor having a high Q, comprising the steps of: providing a substrate having upper and lower surfaces; forming a first coil having a first predetermined number of turns arranged in a first plane relative to one of the surfaces of the substrate; and forming a second coil having a second predetermined number of turns arranged in a second plane relative to one of the surfaces of the substrate, such second coil being vertically aligned with the first coil in a direction perpendicular to one of such surfaces of the substrate. Per the foregoing exemplary methodology, preferably the first predetermined number of turns are situated so as to occupy a planar area which is substantially equal to a planar area occupied by such second predetermined number of turns as situated.

Additional present exemplary methodology involves methodology for forming an integrated passive device, comprising the steps of: providing a substrate having an upper surface and a lower surface; providing at least one passive device supported by such substrate, such at least one passive device comprising one of capacitors and resistors; and forming at least one planar inductor having a high Q. In such methodology, such planar inductor preferably comprises a first coil having a first predetermined number of turns supported in a first plane relative to one of the surfaces of such substrate and a second coil having a second predetermined number of turns supported in a second plane relative to one of the surfaces of the substrate, and with the second coil being vertically aligned with the first coil in a direction perpendicular to one of the surfaces of such substrate, with the first predetermined number of turns situated so as to occupy an area within the first plane which is substantially equal to an area occupied by such second predetermined number of turns as situated within the second plane.

Additional objects and advantages of the present subject matter are set forth in, or will be apparent to those of ordinary skill in the art from, the detailed description herein. Also, it should be further appreciated by those of ordinary skill in the art that modifications and variations to the specifically illustrated, referenced, and discussed features and/or steps hereof may be practiced in various embodiments and uses of the disclosed technology without departing from the spirit and scope thereof, by virtue of present reference thereto. Such variations may include, but are not limited to, substitution of equivalent means, steps, features, or materials for those shown, referenced, or discussed, and the functional, operational, or positional reversal of various parts, features, steps, or the like.

Still further, it is to be understood that different embodiments, as well as different presently preferred embodiments, of the present technology may include various combinations or configurations of presently disclosed steps, features or elements, or their equivalents (including combinations of steps, features or configurations thereof not expressly shown in the figures or stated in the detailed description).

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
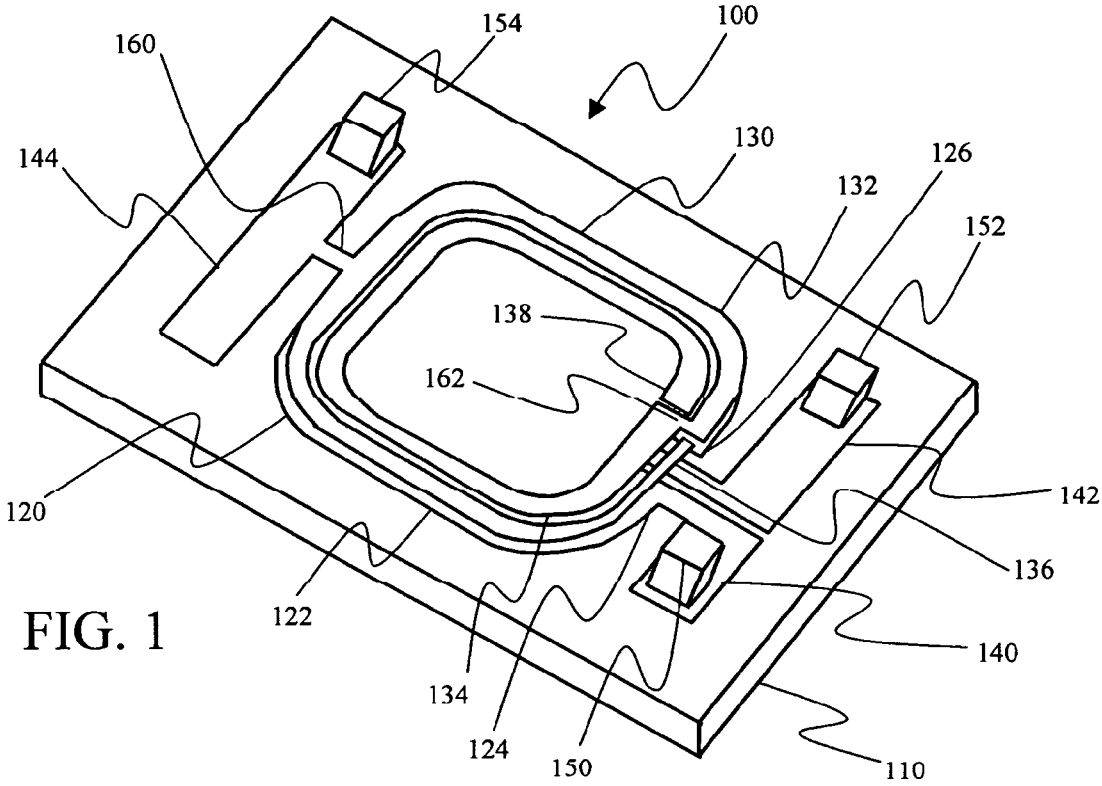
FIG. 1 illustrates a generally top, partially oblique schematic view of an exemplary planar inductor in accordance with the present technology.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with certain aspects of inductive components employable in association with Integrated Passive Devices (IPDs) and related technology and methodology. More particularly, the present subject matter is concerned with an improved planar inductor component designed to provide a high Q, and corresponding methodologies. Similarly, the present subject matter is concerned with such improved planar, high Q inductor component technology, designed to provide components usable singularly or with other components associated with the implementation of Integrated Passive Devices.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to exemplary presently preferred embodiments involving the subject planar inductor. Referring now to the drawings, FIG. 1 schematically illustrates a generally top, partially oblique view of an exemplary embodiment of a planar inductor 100 constructed in accordance with the present technology. In accordance with the present technology, planar inductor 100 may be formed as a two-level coil supported on a substrate 110. The first level 120 of such two-level coil corresponds to a single, relatively wide, coil turn 122. The second level 130 of the two-level coil corresponds in this embodiment to a two-turn spiral, corresponding to a pair of turns 132, 134 physically placed on top of first turn 122 and separated therefrom by a layer of insulating material (not shown in FIG. 1). Although not required as a broader aspect of the present subject matter, the internal turn of such pair of turns 132, 134 corresponding to the two-turn spiral may be wider than the outer turn in accordance with the present disclosure, to accommodate current crowding in the inductor. Also, in some embodiments of the present subject matter, more than a pair of turns may be used on such second level 130. In addition, the first level 120 may also correspond to more than one wide turn with plural correspondingly narrow turns corresponding to the second level 130. It should also be borne in mind that the relative relationship of the first and second levels may be interchanged, i.e., the second level may actually be below the first level or vice versa.

As further illustrated in FIG. 1, representative termination pad 140 may be coupled to a first end 124 of the single, relatively wide coil turn 122. As understood by those of ordinary skill in the art, second end 126 of coil turn 122 may be coupled by conductive vias (not shown in FIG. 1) to a first end 136 of the exemplary more narrow conductor second level spiral coil that generally follows the same path as the first level coil. As the second level spiral coil traverses the path of the first level coil, several features may be noted. One feature corresponds to a tap connection 160 (as will be described further below), and another to a crossover area 162. By using relatively more narrow conductors for the second layer of the two-layer coil, and by using the illustrated crossover area 162, two complete turns may be provided in substantially the same size area as that occupied by the single turn 122 of first coil layer 120.

As the second level spiral coil continues beyond crossover area 162, the second level coil with turns 132, 134 reaches a second end 138 that may be then coupled, as understood by one of ordinary skill in the art, by vias (not shown in FIG. 1) to conductive traces connected to exemplary terminal pad 142. In an exemplary configuration, such coil turns may correspond to 20 μm thick copper (Cu) layers while the layer of insulating material not shown in FIG. 1 may correspond to a 5 μm thick layer of benzocyclobutene (BCB).

It should be clearly borne in mind that such specific examples are exemplary only and that both the coil turn material and insulating material may correspond to other readily available suitable materials, and that the above exemplary dimensions may be varied per circumstances of a given embodiment, in accordance with present subject matter. Specific non-limiting examples of conductive materials that may be employed in place of or in addition to copper (Cu) include gold (Au), silver (Ag), and aluminum (Al). Likewise, in place of or in addition to the BCB insulating material, other non-limiting examples of insulating material include polyimide (PI), epoxy resin (FR-3, FR-4, FR-5), bis-triazine resin (BT), cyanate ester resin, Parylene, $SiO_2$, $Si_3N_4$, Teflon®, flouropolymers, alumina, and magnesium alumina silicates.

As previously mentioned, the two spiral turns 132, 134 corresponding to the second level 130 of an exemplary two-level coil are, in accordance with present subject matter, physically relatively more narrow than the single turn 122 corresponding to the first coil layer 120 of the present exemplary two-level coil. The placement of such at least two spiral, relatively more narrow, turns 132, 134 in vertical alignment with the single, wider turn 122, produces a strong mutual coupling of all the exemplary turns (122, 132, 134) of the exemplary composite planar inductor, resulting in an increase in quality (Q) factor for the planar inductor over that obtained from prior configurations.

With further reference to FIG. 1, exemplary termination pads 140, 142, 144 may be provided for coupling exemplary planar inductor 100 to additional components. Such coupling may be accomplished such as by way of solder balls 150, 152, 154, respectively, used as a ball grid array (BGA) termination of the inductor device. Alternatively, embodiments utilizing surface mount technology may be practiced in place of BGA-based approaches. Exemplary planar inductor 100 may be provided as a center-tapped device by way of center tap connection 160 and the previously mentioned exemplary termination pad 144.

Figure 2:
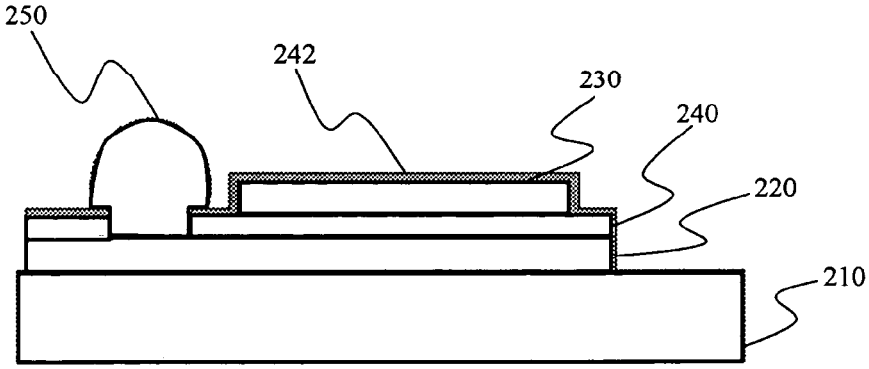
FIG. 2 illustrates a cross-section of a portion of the exemplary planar inductor embodiment of FIG. 1.

Referring now to FIG. 2, an exemplary cross section of a portion of the exemplary planar inductor of FIG. 1 is illustrated. A planar inductor in accordance with the present technology may be constructed on a substrate 210 of glass or glass-ceramic material. It should be clear to those of ordinary skill in the art that other materials may be used as the substrate material, depending on the exact requirements of the environment in which the final device is to be used. For example, ceramic or non-ceramic materials may be used. Several additional specific examples would include quartz and high resistivity Si, as well as still additional specific examples set forth in the remainder of this specification.

It should also be clear to those of ordinary skill in the art that the presently disclosed high Q planar inductor technology can be used as an embedded element in printed wiring board laminates or multilayer ceramic packages.

In an exemplary embodiment, substrate 210 may correspond to a 0.5 mm thick glass or glass-ceramic layer, and construction of such subject planar inductor may be begun by electro-plating 20 μm of copper (Cu) 220 into a photoresist mask over a seed layer of TiW (600 Å)/Cu (0.5 μm). The seed layer is etched away after plating. A second layer of copper (Cu) 230 may be plated over a layer of photosensitive BCB 240 provided as an insulator layer between the two copper layers. BCB layer 240 may typically be approximately 10 μm thick. Alternative insulating layer material, e.g., $Si_3N_4$, may be used in place of the exemplary BCB material. As understood by those of ordinary skill in the art, vias (not shown in FIG. 2) may be patterned into the BCB layer 240 in order to connect the two copper layers 220 and 230. An additional layer of BCB may also be applied as layer 242 for planarization and final passivation of the structure. The structure may be terminated with a ball grid array (BGA) using ball placement technology providing such as solder balls 250, as required. Solder balls 250 may comprise eutectic tin-lead (SiPb) but can be lead (Pb) free, if desired.

Figure 3:
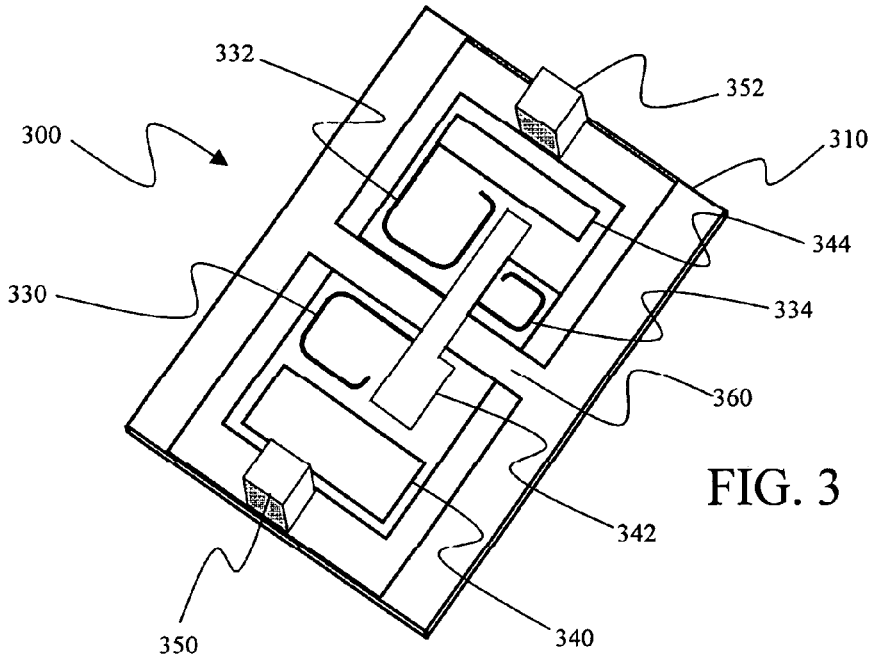
FIG. 3 illustrates a generally top, partially oblique schematic view of an exemplary filter employing a plurality of planar inductors constructed in accordance with the present technology.

With reference now to FIG. 3, an exemplary filter 300 in accordance with present subject matter is illustrated in a generally top, partially oblique schematic view thereof, employing a plurality of representative planar inductors 330, 332, 334, such as previously described with reference to FIG. 1. As a variety of filters, including bandpass filters and bandstop filters as well as other filter types and combinations thereof, may be designed using the present planar inductor technology, it should be kept in mind that the exemplary filter 300 illustrated in FIG. 3 is representational only, and is not meant to specifically depict any particular type filter.

As illustrated in FIG. 3, exemplary filter 300 may correspond to a radio frequency (RF) filter including (but not limited to) a plurality of exemplary planar inductors 330, 332, 334 mounted along with exemplary capacitor elements 340, 342, 344 on an insulating substrate 310. In an exemplary configuration, such insulating substrate 310 may correspond to a glass substrate although, of course, any number of other materials including, as non-limiting examples, Si, $Al_2O_3$, glass-ceramic wafers, quartz, high resistivity Si, magnesium oxide, Saphire, Kapton, polyimide film, Teflon® sheet, fluropolymer laminate, FR-4 laminate, BT-laminate, or cyanate ester laminate may be used for substrate 310 as well as substrate 110 illustrated in FIG. 1, as required to meet specific design considerations.

At this juncture it should be noted that although the principle discussion of the present disclosure relates to the provision of planar inductors on surface material such as those just mentioned, the present technology is not so limited as such may also be applied to printed circuit wiring boards with equal facility. Input and output connections to filter 300 may be effected by way of solder balls 350, 352, such as portions of a ball grid array (BGA), as previously described with respect to FIG. 1. Exemplary solder balls 350, 352 of FIG. 2, as well as those represented at 150, 152, 154 of FIG. 1, may be selected to be lead-free, if appropriate to the intended use of any specifically produced device. Alternative methodologies may, of course, be employed in place of solder ball process including as non-limiting examples solder paste screen printing, solder plating, solder jetting, gold ball bumping, and copper stud bumping. It should be further noted that the present technology is not limited to a ball grid array (BGA) format but may also be applied in a surface mount (SMT) format so that single passive components, in our present context, planar inductors, may be provided and terminated as BGA or SMT.

In the design of small, integrated radio frequency (RF) devices, the parasitic coupling between components, in accordance with the present disclosure, plays an important role. As understood by those of ordinary skill in the art, the value and placement of such various components may be adjusted to fit the desired filter transfer function. In addition, the ground traces 360 between the resonant circuits have an important role in achieving desired filter parameters.

As a general example of the present technology, a planar inductor was constructed using the design principles disclosed herein. A planar inductor, fabricated on a 2.4 mm by 2.1 mm chip, was found to produce an inductance value of 18 nH with a measured Q in excess of 60.

Figure 4A:
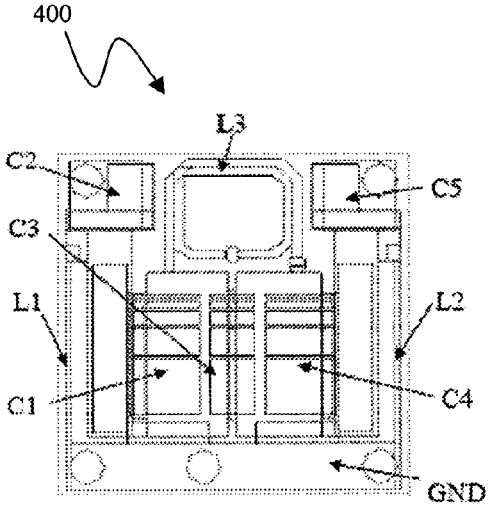
FIGS. 4*a* and 4*b* illustrate, respectively, a layout schematic view and a representative circuit schematic of an exemplary elliptical band-pass filter that may employ one or more planar inductors constructed in accordance with the present technology.
Figure 4B:
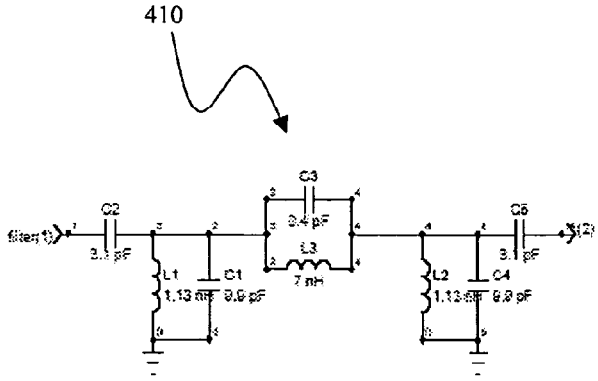

With respect to FIGS. 4*a* and 4*b*, an exemplary configuration of an integrated planar device (IPD) that may be constructed using planar inductors provided in accordance with the present technology is illustrated. FIGS. 4*a* and 4*b* illustrate, respectively, a layout schematic view generally 400, and a representative circuit schematic 410, of an exemplary integrated planar device (IPD) corresponding to an exemplary elliptical band-pass filter embodiment that may be constructed in accordance with incorporation of one or more components in accordance with the present technology. As may prominently be seen located at the top center portion of FIG. 4*a*, an inductor L3 is shown as a portion of such a filter. Inductor L3 may be constructed in accordance with the present technology as previously described with respect to FIGS. 1 and 2. In such exemplary configuration, inductor L3 corresponds to a 7 nH inductor. Constructing inductor L3 in accordance with the present technology provides an opportunity to significantly increase the "Q" and, consequently, improve the circuit operating parameters over those obtainable using prior planar inductor construction methodologies.

Still further in such exemplary configuration represented by FIGS. 4*a* and 4*b*, additional exemplary inductors L1 and L2 may be included in such exemplary specific arrangement, and provided each with inductor values corresponding to 1.13 nH. Similarly, each of exemplary capacitors C1, C2, C3, C4 and C5 may be provided in accordance with such exemplary embodiment, and having exemplary specified values of capacitance. For example, as illustrated by FIG. 4*b*, C1 and C4 may be provided values each of 9.9 pF, while C2 and C5 each may be provided with values of 3.1 pF, and while capacitor C3 is provided with a 0.4 pF value.

While the present subject matter has been described in detail with respect to specific embodiments thereof, it will be appreciated that those skilled in the art, upon attaining an understanding of the foregoing, may readily adapt the present technology for alterations or additions to, variations of, and/or equivalents to such embodiments. For example, the positioning of the first and second coil levels may be reversed. In addition, some or all of the terminal pads may be configured to be positioned within the area defined by the coil turns. Still further, the present subject matter is intended to be usable with the practice of specific embodiment design techniques and design aids (such as commercially available software) as known to those of ordinary skill in the art, whether with regard to present planar inductors produced as individual components, or integrated as part of more complex integrated devices or combinations. For example, design procedures making use of equivalent or representative circuit analysis for an RF bandpass filter, and modeling of a matching network, may be practiced with the present subject matter. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A planar inductor, comprising:

a substrate having upper and lower surfaces;

a first coil having a first predetermined number of turns arranged in a first plane relative to one of said surfaces of said substrate and supported on said substrate; and a second coil having a second predetermined number of turns arranged in a second plane relative to said one of said surfaces of said substrate and supported on said substrate, said second coil being vertically aligned with said first coil in a direction perpendicular to said one of said surfaces of said substrate;

wherein said first predetermined number of turns occupies a planar area which is substantially equal to a planar area occupied by said second predetermined number of turns.

2. A planar inductor as in claim 1, wherein the number of said second predetermined number of turns is twice the number of said first predetermined number of turns.

3. A planar inductor as in claim 1, wherein:

said first coil has at least one turn corresponding to a conductive element having a first predetermined width; and wherein said second coil has a plurality of turns, each of which said plurality of turns corresponds to individual planar conductors having individual widths corresponding to individual portions of said first predetermined width.

4. A planar inductor as in claim 3, wherein said individual portions are equal.

5. A planar inductor as in claim 3, wherein said plurality of turns are arranged with at least one central turn thereof having a width corresponding to a predetermined portion of said first predetermined width, and with the remaining of said plurality of turns having widths corresponding to progressively smaller predetermined portions of said first predetermined width.

6. A planar inductor as in claim 1, wherein said second coil is vertically aligned above said first coil in a direction perpendicular to a common surface with said first coil.

7. A planar inductor as in claim 1, wherein said substrate comprises a ceramic material.

8. A planar inductor as in claim 1, wherein said substrate comprises one of a glass, glass-ceramic, quartz, and a high resistivity Si material.

9. A planar inductor as in claim 1, wherein said substrate comprises a printed circuit board.

10. A planar inductor as in claim 1, further comprising:

terminations associated with beginning and end portions of both of said first and second coils; and at least one connection point associated with a mid portion of said second coil;

wherein said first coil and said second coil are electrically connected in series by way of said terminations, and wherein an inductor center-tap is provided by way of said connection point.

11. A planar inductor as in claim 1, further comprising:

a plurality of said planar inductors supported by said substrate; and a plurality of capacitors supported by said substrate, and configured with said plurality of planar conductors so as to form an elliptical band-pass filter.

* * * * *